United States Patent [19]

Heimbigner

[11] 4,289,312

[45] Sep. 15, 1981

[54] FINGER GRIP INSERT FOR A BOWLING BALL

[76] Inventor: Donald L. Heimbigner, 9605 SE. 6th St., Vancouver, Wash. 98664

[21] Appl. No.: 142,407

[22] Filed: Apr. 21, 1980

[51] Int. Cl.[3] ..... A63B 37/00

[52] U.S. Cl. ..... 273/63 A

[58] Field of Search ..... 273/63 A, 63 R, 63 B, 273/63 E, 128 R, 128 CS, 128 A

[56] References Cited

U.S. PATENT DOCUMENTS 3,454,440 7/1969 Vezirakis ..... 273/63 A 3,784,198 1/1974 Bach ..... 273/63 A

*Primary Examiner*—George J. Marlo

*Attorney, Agent, or Firm*—James D. Givnan, Jr.

[57] ABSTRACT

A resilient insert for installation within a bowling ball bore for the purpose of cushioning the user's finger tip. One wall segment of the insert extends the length of the insert and is of a greater thickness than at least some of the remaining wall segments of the insert. The internal surface of the one wall segment is formed on a greater radius than the corresponding radii of certain remaining internal surfaces to more closely correspond to the transverse oval shape of the user's finger tip.

2 Claims, 4 Drawing Figures

FINGER GRIP INSERT FOR A BOWLING BALL

BACKGROUND OF THE INVENTION

The present invention pertains generally to a tubular insert for securement within a bowling ball to receive and cushion a bowler's finger.

Known in the present art are various types of bowling ball inserts of the pad type for securement within the ball finger openings. Typical of such pad type inserts are those disclosed in U.S. Pat. Nos. 2,469,268; 2,646,985; 2,708,578; 2,968,484; 2,983,511; 3,342,488 and 3,963,238.

More pertinent is that prior art disclosing tubular shaped inserts such as those disclosed in U.S. Pat. Nos. 2,273,199; 2,844,375; 3,012,783; 3,129,002; 3,148,881; 3,316,588; 3,416,796; 3,454,440 and 3,861,681. Of the immediately foregoing patents most pertinent is believed to be U.S. Pat. No. 2,273,199 which discloses a tubular, resilient insert for securement within a bowling ball and having a cylindrical inside surface with the insert having a lubricant added during insert manufacture. The cylindrical insert is of a constant wall thickness, and is retained in place by means of a shoulder formed on the ball. U.S. Pat. No. 2,844,375 discloses a bowling ball finger grip device wherein a rotatable finger receiving cavity of a ball insert is axially offset from the insert axis for the purpose of providing adjustable spacing between the finger and thumb openings. U.S. Pat. No. 3,129,002 discloses finger and thumb inserts of rigid construction having cylindrical inner wall surfaces. U.S. Pat. No. 3,316,588 discloses an insert for bowling balls configured to the lengthwise shape of the finger or thumb inserted therein but having flat finger contactible surfaces. The same is true for U.S. Pat. No. 3,454,440. U.S. Pat. No. 3,861,681 discloses a bowling ball insert of complex structure enabling adjustment of both the span plane and the pitch of finger receiving sockets.

SUMMARY OF THE PRESENT INVENTION

The present invention is embodied within a resilient insert for bowling balls which insert is highly resilient with a segment of increased wall thickness serving to cushion the user's finger. Lengthwise extending wall segments are of uniform section throughout their length. One of said segments is particularly shaped to receive and cushion an inserted finger tip. Increased wall thickness and internal contour of the insert cushion the finger tip while not jeopardizing ball release. Further, the critical ball bridge area intermediate the ball finger holes is not encroached upon. The bowling ball industry considers as important to ball integrity a bridge thickness of at least three sixteenths inch and preferably at least one quarter inch with any lesser bridge thickness between ball openings jeopardizing ball strength and hence any manufacturer's warranty thereon. Depending upon the hand size of the bowler, careful consideration must be given to avoiding boring of the ball for insert reception in a manner jeopardizing bridge thickness. In some instances, providing an optimum wall thickness for an insert would result in closely spaced apart ball bores requiring re-boring of the ball in a manner violating desired bridge thickness.

A further important feature of the present insert is the internal contour of a finger engaged surface which surface is oval to correspond to finger tip shape.

Important objects of the present invention include the provision of a bowling ball insert of a resilient tubular nature having wall segments of different thicknesses; the provision of a bowling ball insert wherein the internal wall surface of the insert is of generally oval configuration with a surface of lesser curvature adapted to receive a user's finger tip; the provision of a resilient bowling ball insert adapted for securement within a ball with the insert outer end substantially flush with the ball surface; the provision of a resilient bowling ball insert to cushion the finger yet permit rapid disengagement of the finger tip.

DETAILED DESCRIPTION OF THE PREFERRED EMBODIMENT

Figure 1:
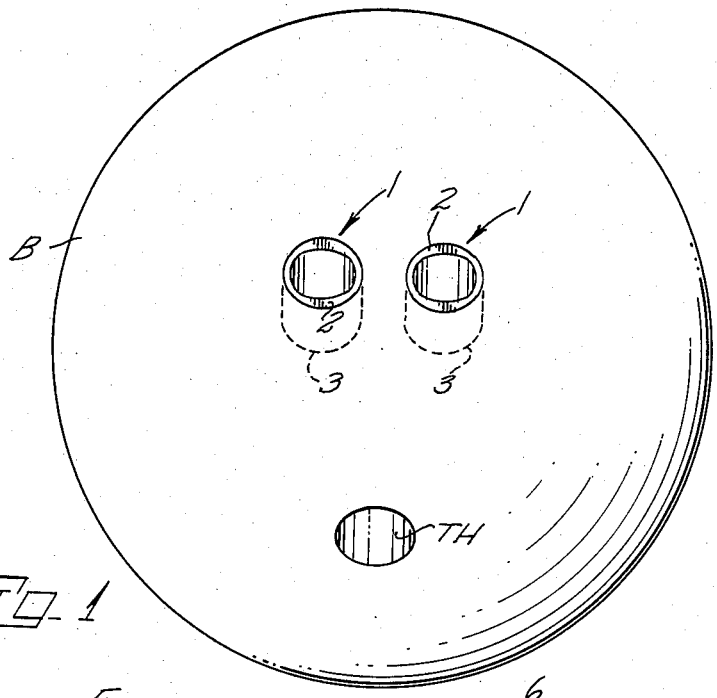
FIG. 1 is a plan view of a bowling ball provided with a pair of the present inserts.
Figure 2:
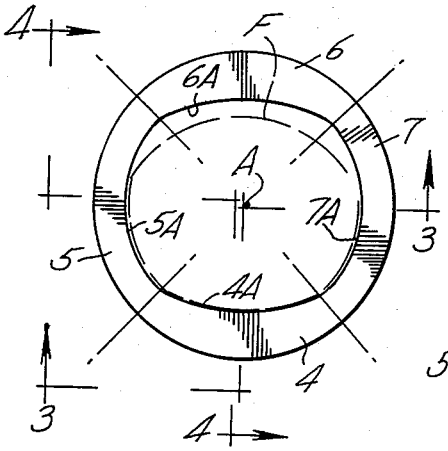
FIG. 2 is an enlarged top plan view of an insert removed from the bowling ball.

With continuing reference to the drawing wherein applied reference numerals indicate parts similarly hereinafter identified, the reference numeral 1 indicates generally the present finger grip insert in place within a bowling ball B. A ball thumb hole is indicated at TH.

With attention to insert 1, the outer end of the insert is indicated at 2 with the opposite or inner end indicated at 3.

Figure 3:
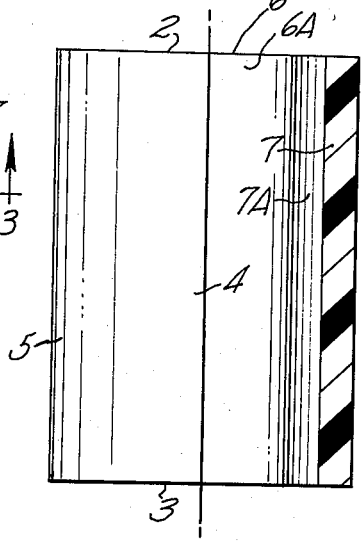
FIG. 3 is a view taken approximately along line 3—3 of FIG. 2.

With attention to FIG. 3, the end view thereof discloses wall segments 4 and 6 oppositely disposed from the major axis A of the tubular insert with each wall surface having an inner surface at 4A and 6A. Each wall segment 4 and 6 is of uniform section throughout its length. The transverse curvature of inner wall surfaces 4A and 6A results from being formed on greater radii than the later described remaining inner wall surfaces of remaining wall segments.

Indicated at 5 and 7 are remaining wall segments each segment having an inner surface at 5A and 7A. Segments 5 and 7 are of uniform thickness both transversely and throughout their length with inner surfaces 5A and 7A being of greater curvature (formed on lesser radii) than inner wall surfaces 4A and 6A. Wall segments 5 and 7 are hereinafter termed a first pair of wall segments while wall segments 4 and 6 are later referred to as a second pair of wall segments.

When in place within the ball, insert 1 is orientated so as to locate a wall segment 4 or 6 toward thumb hole TH to locate a thicker wall segment to receive and cushion the user's finger tip. Such positioning of the insert provides a resilient wall segment of adequate thickness and hence greater cushioning action than would be the case if wall segment 5 or 7 were disposed toward thumb hole TH. Further, the lesser thickness of wall segments 5 and 7 permit the insert to be of an outside diameter small enough to avoid jeopardizing the requisite bridge thickness between the two adjacent finger holes.

Figure 4:
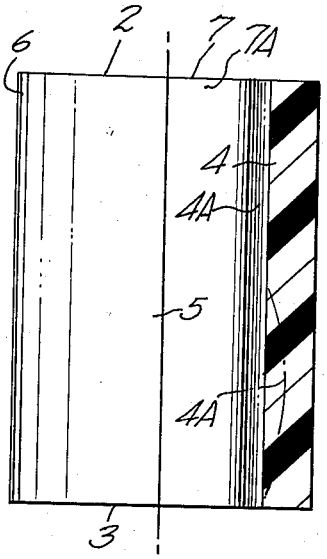
FIG. 4 is a view taken approximately along line 4—4 of FIG. 3.

One embodiment of the present insert is molded from a soft vinyl material marketed under the registered trademark Chem-o-sol having a Shore durometer rating, type A-2 (10 second indentation) of 50. The insert being of soft vinyl compresses under finger tip exerted forces per the broken line position of FIG. 4 to provide comfortable, secure reception of the finger tip without risk of finger tip "hang up" at ball release. Other natural or synthetic resilient materials, of course, may be used.

In one embodiment of the present insert, the insert had an outside diameter of thirty-one thirty-seconds of an inch and is of one and three-eighths inch length. Inner wall surfaces 5A and 7A may be formed on a three-eighth inch radius with a center coincident with the major axis of the insert while wall surfaces 4A and 6A are formed on radii of greater length to provide wall surfaces of lesser curvature to more accurately correspond to the curvature of a contacting finger tip at F. Maximum wall thickness of wall segments 4 and 6 is approximately three sixty-fourths of an inch greater than the wall thickness of segments 5 and 7 to better cushion the finger tip. A range of inserts are manufactured with the largest internal crosswise dimension (i.e., between wall surfaces 5A and 7A) ranging from nineteen to twenty-eight thirty-seconds of an inch to best suit individual finger sizes.

Securement of the insert in place within the bowling ball is best accomplished with an epoxy base glue at the inner end of the insert.

For present purposes, the thumb is to be construed as a finger, that is, the present insert may be sized for installation within the thumb hole of a bowling ball.

While I have shown but one embodiment of the invention it will be apparent to those skilled in the art that the invention may be embodied still otherwise without departing from the spirt and scope of the invention.

Having thus described the invention, what is claimed and desired to be secured under a Letters Patent is:

1. A finger grip insert for bowling balls, said insert comprising, a tubular resilient body having an outer wall for recessed securement within a bowling ball bore, and wall segments of the tubular resilient body extending lengthwise of said body, a first pair of said wall segments each of uniform thickness and having a curved inner wall surface concentric with the adjacent outer wall of the insert, a second pair of wall segments each of a greater thickness than that of the first pair of wall segments and each having an inner wall of less transverse curvature than the inner surfaces of said first pair of wall segments whereby adequate cushioning of an inserted finger tip bearing on one of said second walls is effected without impeding finger tip insertion or removal from the insert.

2. The insert claimed in claim 1 wherein the wall surfaces of the pair of wall segments of lesser thickness are formed on a center coaxial with the lengthwise axis of the insert.

* * * * *